US007128623B2

(12) United States Patent
Kitajima

(10) Patent No.: US 7,128,623 B2
(45) Date of Patent: Oct. 31, 2006

(54) TAB TERMINAL

(75) Inventor: Yoshikazu Kitajima, Kawagoe (JP)

(73) Assignee: Kyoshin Kogyo Co., Ltd., Tokyo (JP)

( * ) Notice: Subject to any disclaimer, the term of this patent is extended or adjusted under 35 U.S.C. 154(b) by 12 days.

(21) Appl. No.: 10/803,959

(22) Filed: Mar. 19, 2004

(65) Prior Publication Data

US 2004/0214480 A1 Oct. 28, 2004

(30) Foreign Application Priority Data

Apr. 28, 2003 (JP) ..... 2003-123943

(51) Int. Cl.
*H01R 4/02* (2006.01)

(52) U.S. Cl. ..... 439/876; 439/83

(58) Field of Classification Search ..... 439/876, 439/866, 83, 845, 849, 850
See application file for complete search history.

(56) References Cited

U.S. PATENT DOCUMENTS 3,492,628 A * 1/1970 Matthews ..... 439/81
4,037,898 A * 7/1977 Guyette ..... 439/82
4,299,436 A * 11/1981 Ackerman ..... 439/853
4,332,430 A 6/1982 Clark
4,873,615 A * 10/1989 Grabbe ..... 361/742
4,907,991 A * 3/1990 Kobayashi ..... 439/876
4,972,295 A * 11/1990 Suguro et al. ..... 361/706
5,192,228 A * 3/1993 Collins et al. ..... 439/567
5,395,256 A 3/1995 Niessen et al.
5,462,443 A * 10/1995 Kurbjuhn et al. ..... 439/78
6,761,598 B1 * 7/2004 Onizuka et al. ..... 439/876

FOREIGN PATENT DOCUMENTS

JP 2002-324606 A 11/2002

* cited by examiner

*Primary Examiner*—Briggitte Hammond
*Assistant Examiner*—X. Chung-Trans
(74) *Attorney, Agent, or Firm*—Birch, Stewart, Kolash & Birch, LLP

(57) ABSTRACT

A tab terminal, capable of being mounted in a parts mounting space on a printed circuit board which is small in height, includes a terminal body, an extension portion formed integrally with the terminal body so as to extend from one end edge of the terminal body in the longitudinal direction thereof, side wall portions formed integrally with the terminal body so as to extend from side edges of the terminal body in the height direction of the tab terminal, respectively, and contact portions formed integrally with the side wall portions so as to extend from distal end edges of the side wall portions in substantially parallel to the terminal body, respectively. The extension portion is adapted to be connected with an electrical connecting part, and the tab terminal is fixedly connected at the contact portions to the printed circuit board.

6 Claims, 2 Drawing Sheets

TAB TERMINAL

CROSS-REFERENCE TO A RELATED APPLICATION

This nonprovisional application claims priority under 35 U.S.C. §119(a) on Patent Application No. 2003-123943 filed in Japan on Apr. 28, 2003, the entire contents of which are hereby incorporated by reference.

BACKGROUND OF THE INVENTION

1. Field of the Invention

The present invention relates to a tab terminal mounted on a printed circuit board.

2. Description of the Related Art

In electrical equipment, a printed circuit board is widely used, which is formed with a conductor pattern and to which various electrical circuit component parts are mounted. Also mounted to the printed circuit board is a tab terminal that is used to connect the conductor pattern with an external electrical circuit. Typically, the tab terminal comprises contact portions soldered to the conductor pattern, and a fitting portion to which a receptacle terminal is fitted. The receptacle terminal is connected through an electric wire to an external electrical circuit (refer to JP-A-2002-324606).

The aforementioned conventional tab terminal is designed to be mounted on a printed circuit board in such a manner that it extends vertically from a surface of the printed circuit board, thus making the height dimension of a parts mounting space on the printed circuit board large. In addition, as mentioned above, the receptacle terminal is fitted to the fitting portion of the tab terminal and the wire is connected to the tab terminal, and therefore, the parts mounting space on the printed circuit board is required to have a height dimension larger than at least a total length of the tab terminal and receptacle terminal. In the case of equipment where printed circuit boards are disposed in a multi-stage fashion, the distance between the printed circuit boards must be increased, if the printed circuit board require a parts mounting space which is large in height dimension. For these reasons, equipment comprised of one or more printed circuit boards mounted with the conventional tab terminal becomes large sized. In addition, the conventional tab terminal is arranged to be mounted on the printed circuit board, with its lower leg portions inserted into holes formed in the printed circuit board. Thus, a mounting operation of the tab terminal to the printed circuit board is cumbersome, and automatic mounting using a mounter requires complicated procedures.

SUMMARY OF THE INVENTION

An object of this invention is to provide a tab terminal capable of being mounted in a parts mounting space on a printed circuit board which is small in height.

According to the present invention, there is provided a tab terminal adapted to be mounted on a printed circuit board, which comprises a plate-like tab terminal body; an extension portion formed integrally with the tab terminal body so as to extend from one end edge of the tab terminal body in a longitudinal direction of the tab terminal body, the extension portion being adapted to be connected with an electrical connecting part; first and second side wall portions formed integrally with the tab terminal body so as to extend from opposite side edges of the tab terminal body in a height direction of the tab terminal, respectively; and first and second contact portions formed integrally with the first and second side wall portions so as to extend from distal end edges of the first and second side wall portions in substantially parallel to the tab terminal body, respectively, the tab terminal being fixedly connected at the first and second contact portions to the printed circuit board.

In the present invention, the first and second contact portions may be arranged to extend at an angle slightly smaller than right angles with respect to the first and second side wall portions, respectively. The extension portion of the tab terminal may be formed so that a receptacle terminal serving as the electrical connecting part is fitted to the extension portion. The first and second contact portions may be soldered to solder portions of a conductor pattern formed in the printed circuit board. The tab terminal body may be formed with a picked-up portion to which a pickup such as a suction nozzle of a mounter is accessible. The first and second side wall portions may have a height dimension such that a gap is formed between a surface of the printed circuit board to which the tab terminal is mounted and an adjacent surface of the electrical connecting part connected to the extension portion of the tab terminal.

The tab terminal of this invention is fixedly connected at its first and second contact portions to the printed circuit board in such a manner that the tab terminal body and the extension portion extend along the printed circuit board so as to apart therefrom at a distance corresponding to the height dimension of the first and second side wall portions. Then, an electrical connecting part such as a receptacle terminal is connected to the extension portion of the tab terminal. In this manner, the tab terminal of this invention is mounted to the printed circuit board so as to extend therealong, and the height dimension of the tab terminal (that of the first and second side wall portions thereof) can be made small so long as the electrical connecting part connected to the extension portion of the tab terminal does not interfere with the printed circuit board to which the tab terminal is mounted. Thus, the height dimension of the tab terminal, and by extension the height dimension of the parts mounting space on the printed circuit board, can be reduced as compared to the conventional tab terminal mounted vertically to the printed circuit board. In addition, the extension portion of the tab terminal, to which the electrical connecting part is connected, extends longitudinally of the tab terminal body, and therefore, the electrical connecting part connected to the extension portion also extends along the printed circuit board. In this manner, according to the tab terminal of this invention, the electrical connecting part is disposed along the printed circuit board, and therefore, the height dimension of the parts mounting space on the printed circuit board can be greatly reduced as compared with the case where the electrical connecting part is disposed vertically with respect to the printed circuit board. This contributes to downsizing, especially thinning, of electrical equipment that is constructed using one or more printed circuit boards.

With the tab terminal according to the preferred embodiment where the first and second contact portions individually extend at an angle slightly smaller than right angles with respect to the first and second side wall portions, when the tab terminal is fixedly connected to the printed circuit board by soldering the first and second contact portions to solder portions of the printed circuit board, molten solder adequately enters into gaps between surfaces of the contact portions and surfaces of the solder portions. This ensures that the tab terminal is fixedly connected to the printed circuit board with reliability.

According to the preferred embodiment where the tab terminal body is formed with the picked-up portion, the tab terminal can be surface mounted to the printed circuit board using a mounter, thus improving the efficiency of mounting operation.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

In the following, a tab terminal according to one embodiment of this invention will be explained in detail.

As shown in FIGS. 1–4, the tab terminal 1 of this embodiment comprises a plate-like tab terminal body 1*a*, an extension portion 1*b* extending from one end edge of the tab terminal body 1*a* longitudinally of the tab terminal body 1*a*, first and second side wall portions 1*d* respectively extending from opposite side edges of the tab terminal body 1*a* in the height direction of the tab terminal 1; and first and second contact portions 1*e* respectively extending from distal end edges of the side wall portions 1*d* in substantially parallel to the tab terminal body 1*a*. The extension portion 1*b*, the side wall portions 1*d* and the contact portions 1*e* are formed integrally with the tab terminal body 1*a*. The tab terminal 1 is fabricated by stamping a thin copper plate having a thickness of about 0.5 mm, which is excellent in electric conductivity and is easily stamped out.

Figure 5:
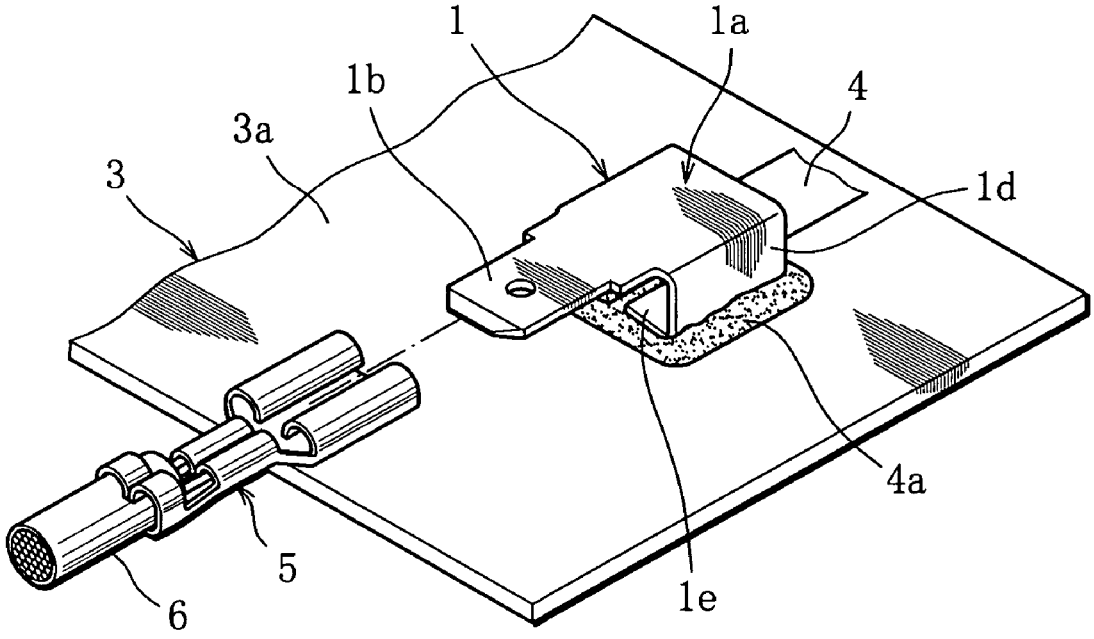
FIG. 5 is a perspective view showing the tab terminal in a state where it is surface mounted to a printed circuit board.

As shown in FIG. 5, the tab terminal 1 is arranged to be mounted on a printed circuit board 3. The tab terminal body 1*a* of the tab terminal 1 is formed with a picked-up portion 1*h*, so that the tab terminal 1 can be mounted to the printed circuit board 3 by using a mounter (not shown) having a pickup such as a suction nozzle which can access to the picked-up portion 1*h*.

The printed circuit board 3 has a surface 3*a* thereof formed with a conductor pattern 4 including solder portions 4*a*. The tab terminal 1 is soldered at its first and second contact portions 1*e* to the solder portions 4*a* of the printed circuit board 3, whereby the tab terminal 1 is fixedly connected to the printed circuit board 3. The first and second contact portions 1*e* are disposed so that their distal ends face with each other with a spacing. These contact portions 1*e* form an angle that is slightly smaller than right angles with respect to the first and second side wall portions 1*d*, respectively. More specifically, when the first and second contact portions 1*e* are placed on the solder portions 4*a* of the printed circuit board 3, outer faces (contact faces) 1*f* of the contact portions 13 obliquely extend at a small angle θ of about 10 degrees with respect to the surface (shown by symbol S in FIG. 4) of the solder portions 4*a* in the direction away from the solder portions, so that a wedge-shaped gap g is defined between the contact faces 1*f* and the surface S of the solder portions 4*a*.

Figure 1:
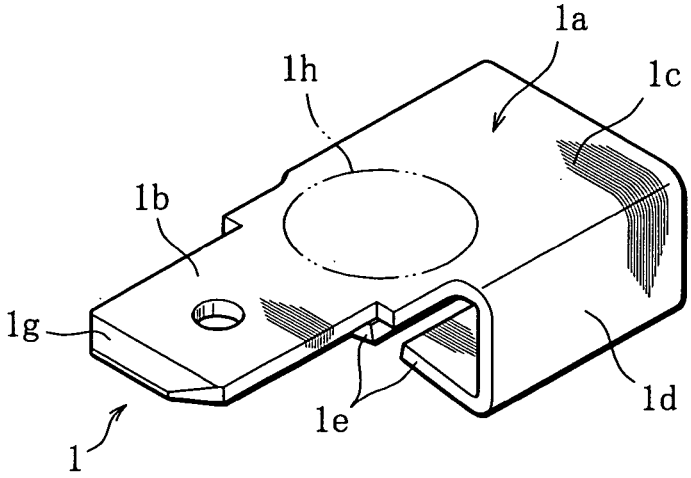
FIG. 1 is a perspective view showing a tab terminal according to an embodiment of this invention.
Figure 2:
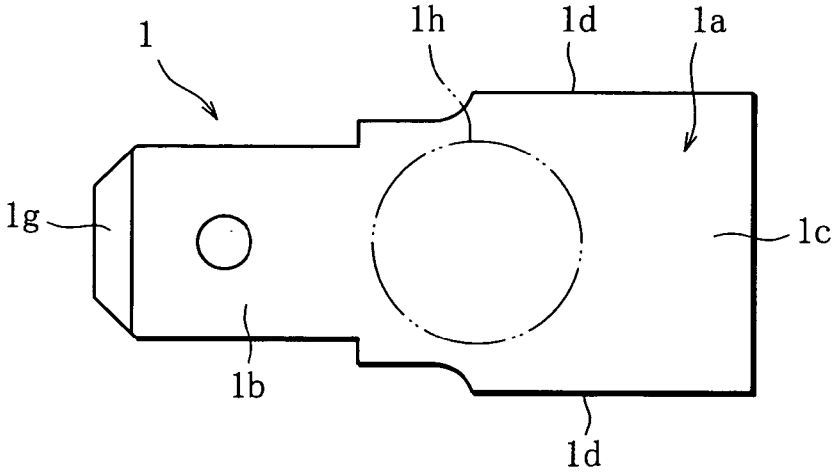
FIG. 2 is a plan view of the tab terminal shown in FIG. 1.
Figure 3:
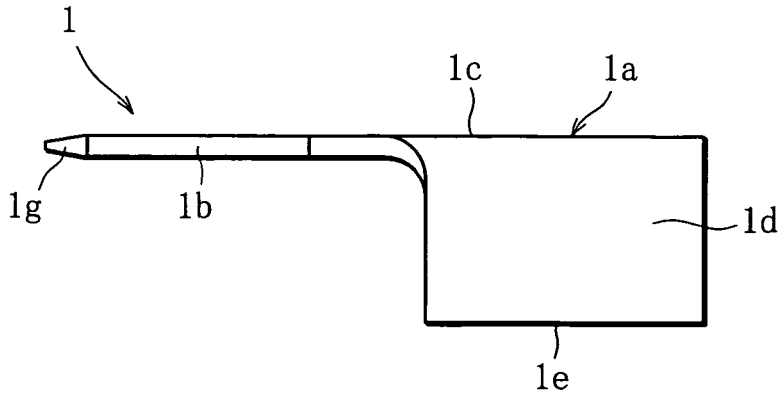
FIG. 3 is a side view of the tab terminal.
Figure 4:
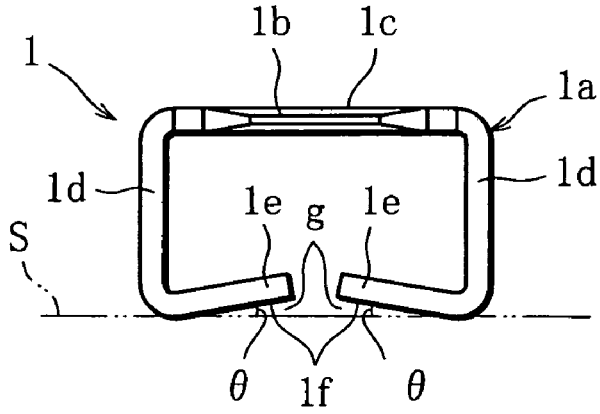
FIG. 4 is a front view of the tab terminal.

In this embodiment, the extension portion 1*b* extends in the longitudinal direction of the tab terminal body 1*a* in flush with the tab terminal body 1*a*, as shown in FIGS. 1 and 2 in which reference numeral 1*c* denotes an upper face of the tab terminal body 1*a*. As shown in FIG. 5, the extension portion 1*b* is formed to have a width narrower than the tab terminal body 1*a*, has a chamfered tip end 1*g*, and is positioned at a predetermined height with respect to the contact portions 1*e*, so that a receptacle 5 as an electrical connecting part may easily be fitted to the extension portion 1*b* with reliability. In this connection, the first and second side wall portions 1*d* of the tab terminal 1 have a height dimension permitting a gap to be defined between a bottom face of the receptacle terminal 5 fitted to the extension portion 1*b* of the tab terminal 1 and the surface 3*a* of the printed circuit board 3 to which the tab terminal 1 is mounted. One end of a wire 6 is clamped by and connected to the receptacle terminal 4, and another end of the wire 6 is connected to an external electrical circuit, not shown.

The tab terminal 1 having the aforementioned construction is picked up by suction at its picked-up portion 1*h* by means of a mounter (not shown) having a suction nozzle and is transported toward the printed circuit 3. Then, as shown in FIG. 5, the tab terminal 1 is placed on the printed circuit board 3, with the contact portions 1*e* respectively aligned with the solder portions 4*a* of the printed circuit board 3. At this time, the extension portion (fitting portion) 1*b* of the tab terminal 1 is disposed to be away from and in parallel to the surface 3*a* of the printed circuit board 1.

Then, the contact portions 1*e* of the tab terminal 1 are soldered to the solder portions 4*a*. On this occasion, the contact faces 1*f* of the contact portions 1*e* extend at a small angle θ to form wedge-like gaps g with respect to the surfaces S of the solder portions 4*a*, and therefore, molten solder adequately enters into the wedge-like gaps g, whereby the contact portions 1*e* are soldered to the solder portions 4*a* with reliability. Thus, the tab terminal 1 is surface mounted onto the printed circuit board 3. Thereafter, the receptacle terminal 5 is fittedly connected to the extension portion (fitting portion) 1*b* of the tab terminal 1.

Since the fitting portion 1*b* is disposed in parallel to the surface 3*a* of the printed circuit board 3, the receptacle terminal 5 is disposed to be in parallel to the printed circuit board 3. Thus, the tab terminal 1 can be mounted to the parts mounting space on the printed circuit board 3 which is small in height dimension. In other words, the height dimension of the parts mounting space on the printed circuit board 3 can be reduced. This makes it possible to downsize and thin down electrical equipment.

The present invention is not limited to the foregoing embodiment, and may be modified variously.

For instance, although the tab terminal of the embodiment has its extension portion arranged to be fitted with a receptacle terminal, electrical connecting part other than the receptacle terminal may be connected to the extension portion. It is not essentially required that the tab terminal is mounted to the printed circuit board using a mounter.

What is claimed is:

1. A tab terminal adapted to be mounted on a printed circuit board, comprising:

a plate tab terminal body to be disposed so as to extend in parallel to the printed circuit board, said tab terminal body having one end edge and opposite side edges;

a tab portion aligned with said tab terminal body so as to integrally extend from the one end edge of said tab terminal body in a longitudinal direction of said tab terminal body, said tab portion being adapted to be connected with an electrical connecting part;

first and second legs formed integrally with said tab terminal body so as to extend from the opposite side edges of said tab terminal body in a direction perpendicular to said tab terminal, respectively; and first and second feet formed integrally with said first and second legs so as to extend from distal end edges of said first and second legs substantially parallel to said tab terminal body respectively, so that first and second feet forms first and second contacts to be connected with the printed circuit board, and wherein said first and second feet extend in direction toward each other at an angle slightly smaller than right angle with respect to said first and second legs, respectively so that wedge-shaped gaps are defined between said first and second feet and the printed circuit board respectively, when the tab terminal is mounted on the printed circuit board.

2. The tab terminal according to claim 1, wherein said extension portion of the tab terminal is formed so that a receptacle terminal serving as the electrical connecting part is fitted to said extension portion.

3. The tab terminal according to claim 1, wherein said first and second contact portions are soldered to solder portions of a conductor pattern formed in the printed circuit board, respectively.

4. The tab terminal according to claim 1, wherein said tab terminal body is formed with a picked-up portion to which a pickup of a mounter is accessible.

5. The tab terminal according to claim 1, wherein said first and second side wall portions have a height dimension such that a gap is formed between a surface of the printed circuit board to which the tab terminal is mounted and an adjacent surface of the electrical connecting part connected to the extension portion of the tab terminal.

6. The tab terminal according to claim 1, wherein the extension portion has a width less than the width of the tab terminal body at the point the extension portion extends from the tab terminal.

* * * * *